US007705700B2

(12) United States Patent
Parker et al.

(10) Patent No.: US 7,705,700 B2
(45) Date of Patent: Apr. 27, 2010

(54) RELAY WITH OVERTRAVEL ADJUSTMENT

(75) Inventors: David Glen Parker, Trinity, NC (US); Kurt Thomas Zarbock, Advance, NC (US); Tim Hasenour, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 128 days.

(21) Appl. No.: 11/957,580

(22) Filed: Dec. 17, 2007

(65) Prior Publication Data

US 2009/0153277 A1 Jun. 18, 2009

(51) Int. Cl.
*H01H 51/22* (2006.01)
*H01H 3/00* (2006.01)

(52) U.S. Cl. ..... 335/86; 335/78; 335/80; 335/185; 335/192

(58) Field of Classification Search ..... 335/18–21, 335/71, 93, 121, 165, 185–192, 78–86, 124, 335/128, 129, 130, 131, 202, 258
See application file for complete search history.

(56) References Cited

U.S. PATENT DOCUMENTS 1,938,405 A * 12/1933 Tamsitt ..... 335/181
2,233,926 A * 3/1941 Stimson ..... 200/241
2,920,160 A * 1/1960 Heath ..... 335/132
3,076,880 A * 2/1963 Ehrismann ..... 335/129
3,748,611 A 7/1973 Heath
5,289,144 A * 2/1994 Liao ..... 335/78
5,572,176 A * 11/1996 Heinzl et al. ..... 335/129
5,905,422 A * 5/1999 Doneghue ..... 335/78

FOREIGN PATENT DOCUMENTS

EP 0 097 199 1/1984
EP 1 143 471 10/2001
FR 840 920 5/1939

OTHER PUBLICATIONS

PCT International Search Report; International Application No. PCT/US2008/013510; International Filing Date Dec. 9, 2008.

* cited by examiner

*Primary Examiner*—Elvin G Enad
*Assistant Examiner*—Mohamad A Musleh

(57) ABSTRACT

An electromagnetic relay has an overtravel adjustment to set the gap in the contact arrangement. The armature is actuated by a relay coil and linked to a pusher to drive the pusher to operate the contact system. The pusher includes a rotary dial disposed in a slot on the pusher adjacent to the armature. The rotary adjustment increases or decreases a gap of the contacts to provide an over-travel adjustment. The pusher includes bifurcated tines defining the slot for receiving an armature linkage and the rotary adjustment. The rotary adjustment includes a head and a post depending from the head. The post is disposed within the slot and the head portion in contact with the armature linkage portion. The rotary adjustment sets the distance between the forward edge and the armature to achieve the desired overtravel for the contact arrangement.

19 Claims, 3 Drawing Sheets

RELAY WITH OVERTRAVEL ADJUSTMENT

BACKGROUND

The application generally relates to an electromagnetic relay. The application relates more specifically to an electromagnetic relay having a relay actuator with an adjustment dial for setting an overtravel adjustment for electrical contacts.

A relay is an electromagnetically actuated electrical switch. Conventional relays include stationary contacts and moving contacts corresponding with the stationary contacts. When the relay is electromagnetically actuated, the moving contacts engage or disengage with the stationary contacts, to respectively close or open an electrical circuit.

A conventional relay has a base structure, a housing, a relay coil, an armature, a pusher and a contact system. The base structure and housing are made of an electrically insulating material and support and enclose the operative electromagnetic parts of the relay. The relay coil has a coil and a magnetically permeable core connected to the tilting armature to move the armature. The coil is a cylindrical hollow member with a rectangular internal cross section corresponding to a cross section of the core, and is spring loaded to return to a specified position when the coil is de-energized. The pusher links the tilting armature and the contact system and transfers the coil force applied to the armature to the contact system.

In manufacturing, the relay stationary contact springs and moving contact springs are set to make contact concurrently when closing. Both the moving and stationary springs include metallic pads or tips, i.e., electrical contacts, which serve as the mutual point of contact. The spring contacts absorb wear and tear caused by the actuation force, electrical arcing, repetitious movements, and other deteriorating factors. To account for this deterioration due to repeated use, an overtravel adjustment is provided in manufacturing. This process involves manipulating the contact springs, which are generally made from copper, copper alloy or similar conductive material. The contact springs must be bent, turned, twisted or otherwise manipulated to attempt to set a uniform overtravel position for the multiplicity of contact springs. Due to the mechanical properties of the metallic contact springs, it is difficult to achieve a reliable and precise overtravel setting.

There is a need for an apparatus and system for automatically achieving a uniform overtravel adjustment for contact springs in an electromagnetic relay.

Intended advantages of the disclosed systems and/or methods satisfy one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to an electromagnetic relay. The electromagnetic relay includes a relay coil, an armature, a pusher and a contact system. The armature is pivotably actuated by the relay coil, and linked to a trailing end of the pusher to drive a forward edge of the pusher to operate the contact system. The pusher includes a rotary adjustment disposed in a slot of the pusher adjacent to the armature. The rotary adjustment when rotated increases or decreases a gap of the contact system to provide an over-travel adjustment of the contact system.

Another embodiment relates to a pusher assembly for use in an electromagnetic relay. The pusher assembly includes a pusher having a pair of bifurcated tines defining a slot for receiving an armature linkage portion and a rotary adjustment. The rotary adjustment includes a head portion and a post depending from the head portion. The post is disposed within the slot and the head portion disposed against the armature linkage portion. Rotation of the rotary adjustment adjusts a distance between the forward edge and the armature by a predetermined interval.

Certain advantages of the embodiments described herein are a simplified, easily replicated and precise mechanism for overtravel adjustment in an electromagnetic relay.

Another advantage is a graduated adjustment dial to set the advance position of the pusher.

Yet another advantage is a slotted adjustment dial to accommodate a screwdriver tool for rotating the dial.

Alternative exemplary embodiments relate to other features and combinations of features as may be generally recited in the claims.

BRIEF DESCRIPTION OF THE FIGURES

Wherever possible, the same reference numbers will be used throughout the drawings to refer to the same or like parts.

DETAILED DESCRIPTION OF THE EXEMPLARY EMBODIMENTS

Figure 1:
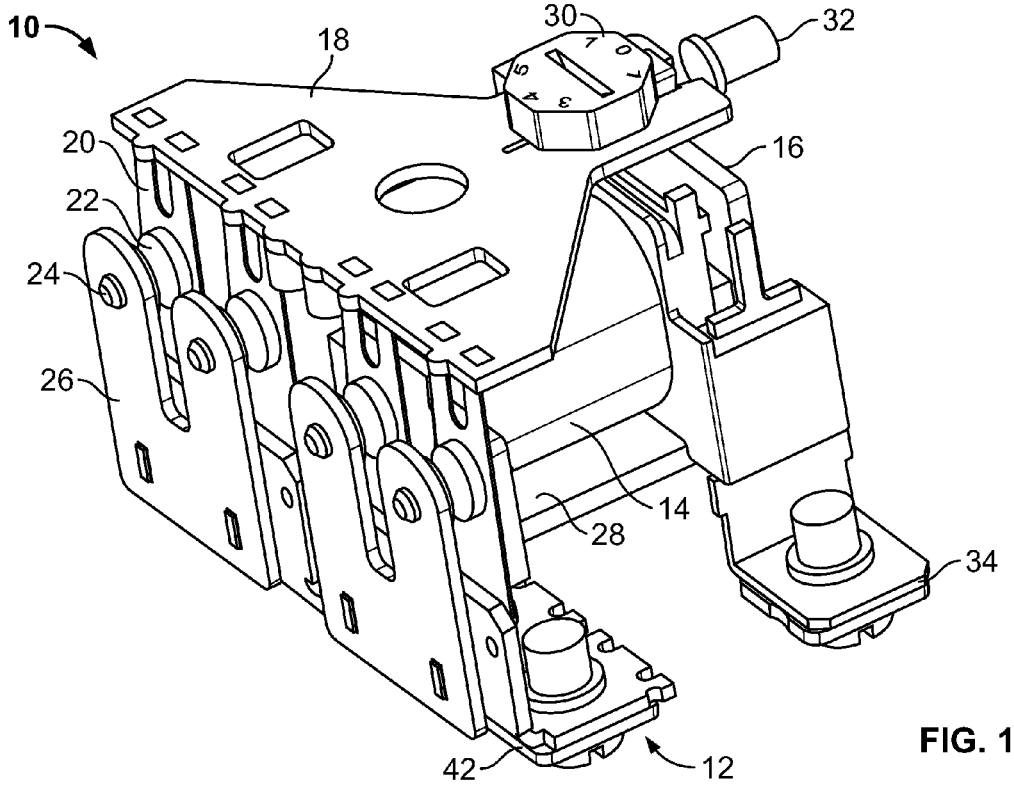
FIG. 1 is a perspective view of the relay operating mechanism.

Referring now to FIG. 1, an electromagnetic relay operating mechanism 10 includes a contact arrangement 12 and a relay coil 14 fixedly mounted on a frame 28. The relay coil 14 operates on a movable hinged armature 16 to move the armature 16 between two positions, one position corresponding to the relay coil 14 energized state and one corresponding to the relay coil 14 deenergized state. The armature 16 is linked to the contact arrangement 12 by a pusher 18. The contact arrangement includes a set of stationary contact springs 26 and a set of moveable contact springs 20. The moveable contact springs 20 are connected at one end to the pusher 18 and at the opposite end to a pivot point 38 (see, E.g., FIG. 2). The armature 16 pivots about a connection point, causing the pusher 18 to move linearly, to a forward position and return position, in response to the actuation force generated by the relay coil 14. The movement armature 16 pushes against the pusher 18. The pusher 18 transfers the armature movement to the moveable contact springs 20 to make contact with the stationary contact springs 26 when the armature 16 moves to the forward position, and to break contact when the armature 16 returns to the return position. The relay operating mechanism 10 may optionally include a test button 32 for manually actuating the armature 16 through the exterior of the relay housing 66 (See, e.g., FIG. 5). When driven to the forward position, the moveable contact springs 20 engage with stationary contact springs 26 at contacts 22, 24, respectively. The spacing of the moveable contact 22 from the stationary contact 24 is set by the dial 30. The contact arrangement 12 also includes external connection terminals 42 that provide electrical termination points on the exterior of the relay housing 66 (See, e.g., FIG. 5). In addition, the frame 28 has external termination points 34 that connect through the relay housing 66, for interconnecting the relay coil 14 to a control circuit or other voltage source. In the exemplary embodiment of FIG. 1, the contact arrangement 12 is illustrated as a two-pole relay, i.e., two sets of stationary contact springs 26 that interface with two sets of moveable contact springs 20, to control two independent sets of external connection terminals 42. It will be appreciated by those skilled in the art that the two-pole relay configuration is merely exemplary, and that more or less poles may be controlled using the operating mechanism 10 disclosed herein, within the scope of the present invention.

Figure 2:
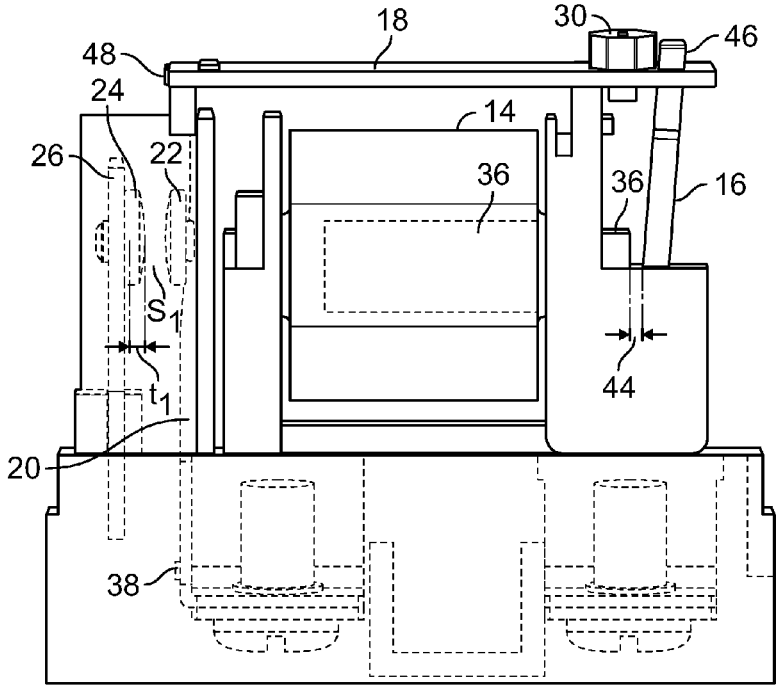
FIG. 2 is an elevational view of the relay operating mechanism.

Referring next to FIG. 2, a side view of the relay operating mechanism 10 is shown. Over-travel of the moveable contact springs 20 is required when initially setting the position of the moveable contact springs 20. Over-travel compensates for contact erosion over time. The additional travel length allows the contacts 22, 24 to meet cycle life requirements as they wear, and the thickness T1 of the contact tips 22, 24 is diminished. In conventional relays, as the thickness t1 diminishes, the gap s1 between one or more pairs of the contact tips 22, 24 increases, until eventually the gap is too great to permit contact to occur when required. The present over-travel adjustment dial 30 provides a means to ensure more even wear and spacing to achieve the desired cycle life. To achieve desired performance a fixed, predetermined gap spacing 44 is provided between the armature 16 and the core 36. The core 36 is magnetized when the relay coil 14 is energized, and the armature 16 moves forward due to the magnetic force applied by the core 36. The armature 16 is spring-biased or otherwise urged away from the core 36 when the core 36 is de-magnetized. The pusher 18 is directly linked by linkage 46 to the armature 16, and travels forward and back an equal distance when the armature 16 moves. Due to molding and stamping tolerances inherent in the manufacturing of various parts, e.g., the terminals 42, 34 and relay coil 14 the position of the armature 16 relative to the contact arrangement 12 may vary inconsistently. The distance d1 between the armature linkage 46 and the forward edge 48 of the pusher 18 is adjustable by turning the dial 30, as will be presently explained. The adjustment of distance d1 changes the spacing s1 proportionally, so the contact tips 20, 26 are set to a desired initial spacing including overtravel.

Figure 3:
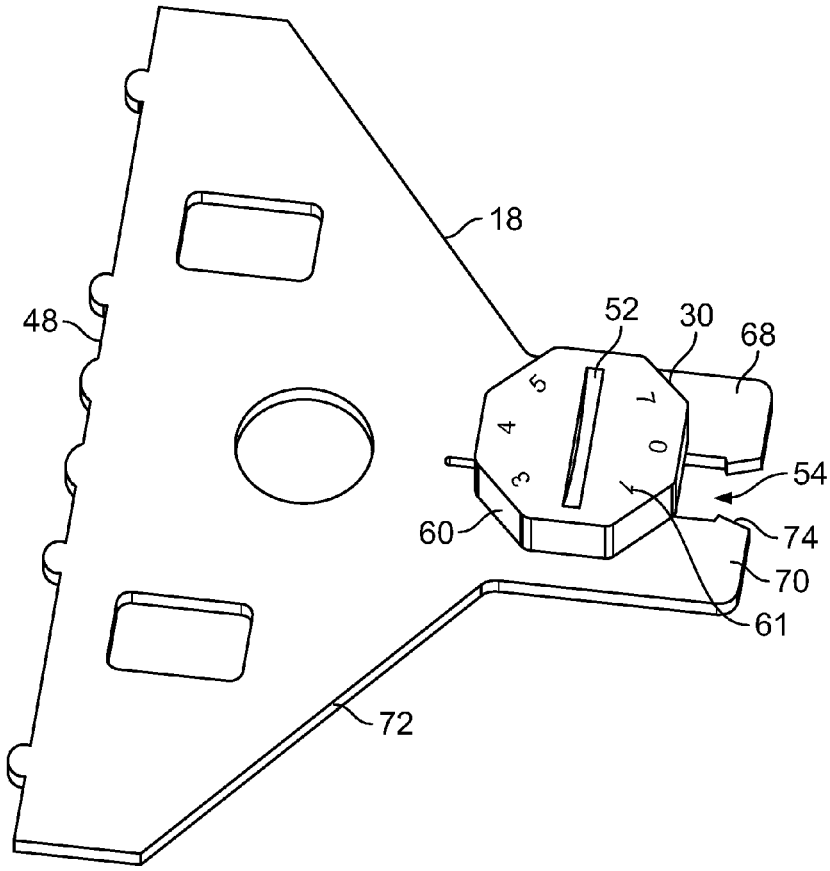
FIG. 3 is a plan view of the pusher.
Figure 4:
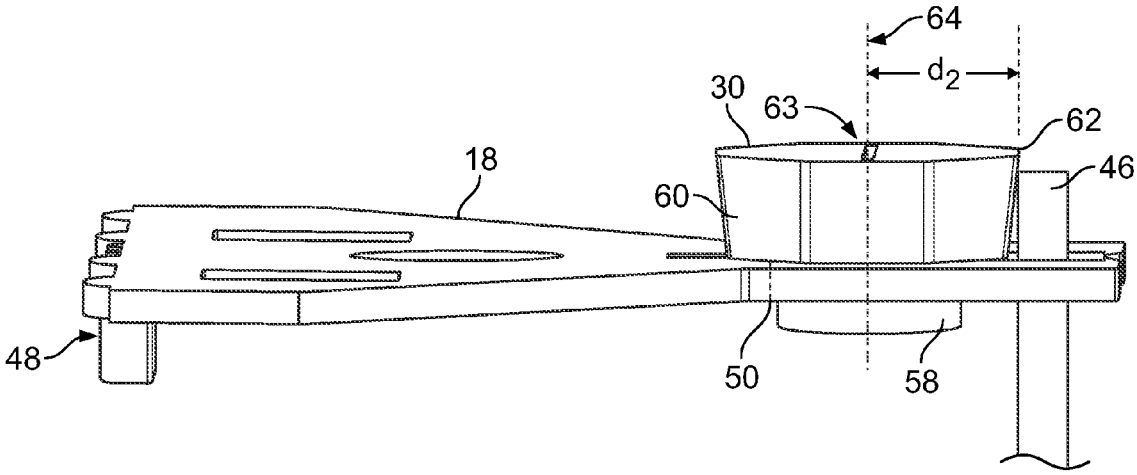
FIG. 4 is an elevational view of the pusher.

Referring next to FIGS. 2 and 3, the pusher 18 includes a slot 54 for receiving the armature linkage 46 and the dial 30. The dial 30 has a geometric head portion 60 and a post 58 depending from the head portion 60. The post 58 is disposed within the slot 54 defined by a pair of bifurcated tines 68, 70 extending from a trailing edge 72 of the pusher 18. Travel of the post 58 is limited in the forward direction by the end wall 50 (FIG. 4) of the slot 54, and in the rearward direction by a pair of opposing stop limits 74 adjacent to the armature linkage 46. The dial 30 may include a recessed screwdriver slot 52 for receiving a screwdriver tip, or other tool receiving configuration, to facilitate rotation of the dial within the slot 54. The head portion 60 is shown in an octagonal configuration, although other configurations with more or less sides may be employed, including triangular, rectangular, pentagonal and hexagonal, depending on the desired number of adjustment increments. Reference marks 61 are provided along each edge of the head portion 60, to indicate the adjustment increments as set forth below in Table 1. The increment values set forth in Table 1 are exemplary, and may be greater or less as required to suit the geometry of the operating mechanism. Referring next to FIG. 4, a side view of the dial 30 illustrates the adjustment increments for one dial position. The distance d2 from the dial side 62 to the axis 64 varies in increments, e.g., of 0.05 mm, progressively from dial position 0 to dial position 7. Dial position 0 corresponds to the shortest distance d2, and for each successive dial position, i.e., dial positions 1 through 7, d2 increases by 0.05 mm up to a maximum of d2 plus 0.35 mm, providing a 0.35 mm overtravel adjustment to the moveable contact springs. Accordingly, the head portion 60 having a center point 63 that is offset from the axis 64 of post 58. The head portion 60 is positioned axially off-center to provide the necessary incremental distances as the head portion 60 is rotated about the axis 64 of the post 58. Since the moveable contact springs 20 are affixed to the forward edge 48 of the pusher 18, rotation of the dial 30 provides precise, uniform adjustment for all of the moveable contact springs 20 concurrently, and equalizes the overtravel setting.

TABLE 1

| Dial Position | Increment Value MM |
|---|---|
| 0 | 0 |
| 1 | .05 |
| 2 | .1 |
| 3 | .15 |
| 4 | .2 |
| 5 | .25 |
| 6 | .3 |
| 7 | .35 |

In a one embodiment, the dial 30 is permanently fixed, e.g., with adhesive glue or epoxy, after the appropriate dial position or overtravel adjustment is selected, so that the relay may not be adjusted again after leaving the factory, since it is contemplated that the dial 30 having been factory set, will require no further adjustment over the cycle life of the relay. Alternately, if desired, the dial may be configured for later adjustment by qualified personnel if desired.

Figure 5:
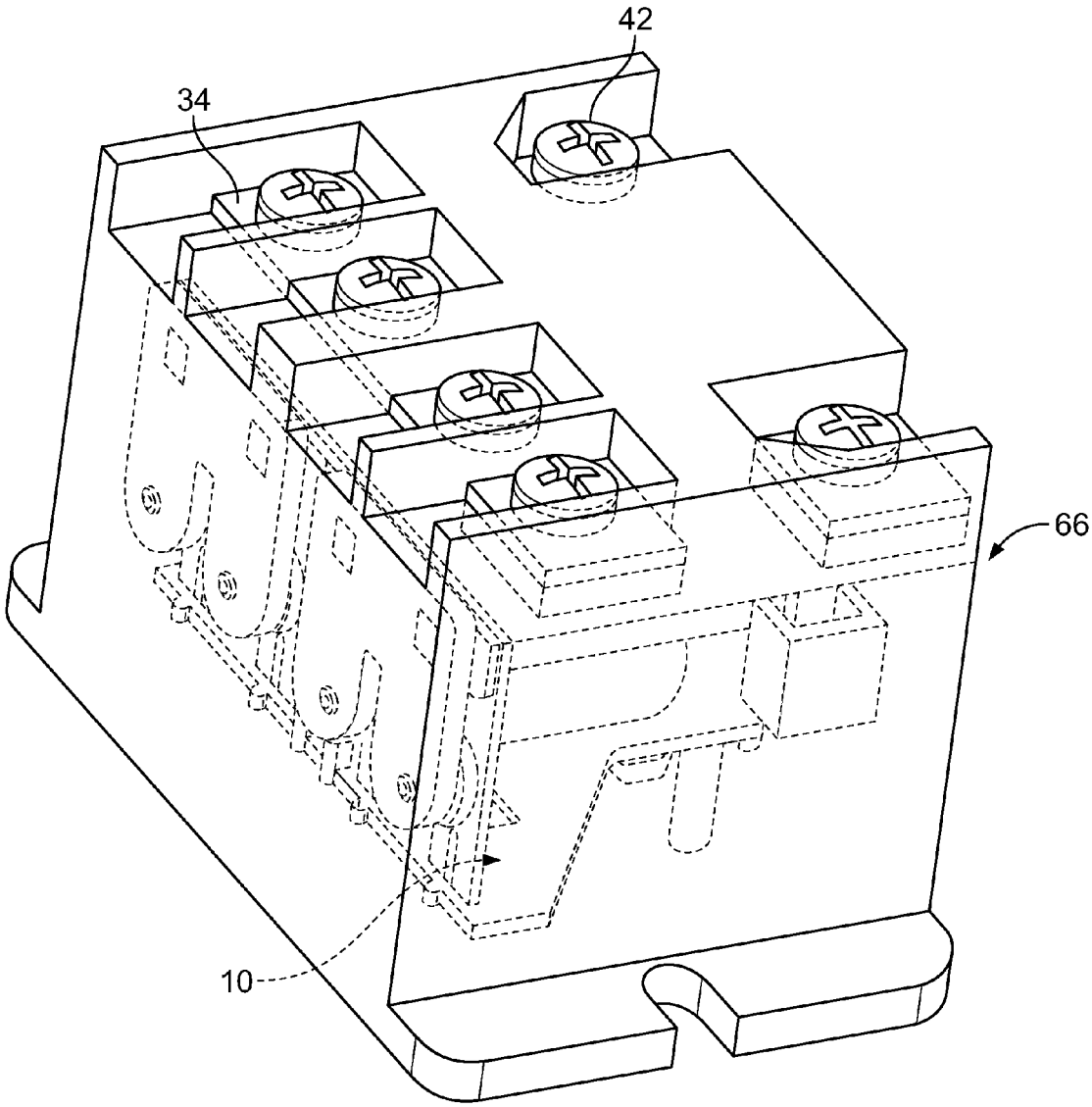
FIG. 5 is a perspective view of an assembled relay.

Referring next to FIG. 5, an assembled relay 66 includes the relay operating mechanism 10 disposed within housing 66, depending from the external screw terminations 34, 42. The coil external screw terminations 42 and the contact external screw terminations 34 face upward to provide access for wiring external control or power circuits.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the relay with over-travel adjustment, as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

What is claimed is:

1. An electromagnetic relay comprising:

a relay coil, an armature, a pusher and a contact system;

the armature pivotably actuated by the relay coil, and linked to a trailing end of the pusher to drive a forward edge of the pusher to operate the contact system; and the pusher further comprising:

a rotary adjustment disposed in a slot of the pusher adjacent to the armature;

wherein the rotation of the rotary adjustment increases or decreases a gap of the contact system to provide an over-travel adjustment of the contact system wherein the pusher further comprises a pair of bifurcated tines defining a slot for receiving an armature linkage portion and the rotary adjustment; the rotary adjustment having a head portion and a post depending from the head portion; and the post disposed within the slot and the head portion disposed against the armature linkage portion; wherein a rotation of the rotary adjustment adjusts a distance between the forward edge and the armature by a predetermined interval.

2. The relay of claim 1, wherein the post is positioned between an end wall of the slot and the armature, wherein a position of the armature linkage is retained in the slot by a pair of opposing stop limits disposed at a distal end of each tine of the pair of tines.

3. The relay of claim 2, wherein the head portion is configured with a plurality of sides of equal length about a periphery of the head portion, each side of the plurality of sides having a center point, and each center point varying a radial distance from an axis of the post a predetermined increment from the adjacent contiguous side.

4. The relay of claim 2, wherein the head portion is configured with a plurality of sides of equal length about a periphery of the head portion, the head portion having a center point offset from an axis of the post to increment an over-travel adjustment distance by a predetermined distance for each side of the head portion when each side of the plurality of sides is rotated in contact with the armature.

5. The relay of claim 4, wherein the plurality of sides are arranged as an octagon.

6. The relay of claim 4, wherein the plurality of sides are configured as one of triangular, rectangular, pentagonal and hexagonal.

7. The relay of claim 1, wherein the contact system comprises:

at least one stationary contact spring and at least one moveable contact spring having a gap separating the at least one stationary contact and the at least one moveable contact spring, the at least one moveable contact spring connected at a first end to the pusher and at a second end to a first pivot point, wherein as the armature pivots, the armature moves the pusher linearly between a forward position and a return position in response to an electromagnetic force generated by the relay coil; and wherein the movement of the pusher causes the at least one stationary contact spring and the at least one moveable contact spring to engage or disengage.

8. The relay of claim 7, wherein each of the at least one stationary contact spring and the at least one moveable contact spring further include at least one contact tip, the respective contact tip of each stationary contact spring and of each moveable contact spring arranged to engage with the contact of an opposing one of the stationary contact spring or the moveable contact spring.

9. The relay of claim 1, further comprising a housing for enclosing the relay coil, the armature, the pusher and the contact system.

10. The relay of claim 9, wherein the relay further includes a test button disposed adjacent to the armature for manually actuating the relay, the test button extending through the exterior of the relay housing and arranged to advance the armature when pushed by an applied external force.

11. The relay of claim 9, further comprising a base structure, the base structure arranged to support the relay coil, the armature, the pusher and the contact system.

12. A pusher assembly for use in an electromagnetic relay comprising:

a pusher having a pair of bifurcated tines defining a slot for receiving an armature linkage portion and a rotary adjustment;

the rotary adjustment having a head portion and a post depending from the head portion;

the post disposed within the slot and the head portion disposed against the armature linkage portion;

the rotary adjustment configured to adjust a distance between a forward edge of the pusher and the armature by a predetermined interval in response to a rotation of the rotary adjustment.

13. The pusher assembly of claim 12, wherein the post is positioned between an end wall of the slot and the armature linkage, wherein a position of the armature linkage is retained in the slot by a pair of opposing stop limits disposed at a distal end of each tine of the pair of tines.

14. The pusher assembly of claim 12, wherein the head portion is configured with a plurality of sides of equal length about a periphery of the head portion, each side of the plurality of sides having a center point, and each center point varying a radial distance from an axis of the post a predetermined increment from the next adjacent side.

15. The pusher assembly of claim 12, wherein the head portion is configured with a plurality of sides of equal length about a periphery of the head portion, the head portion having a center point offset from an axis of the post to increment an over-travel adjustment distance by a predetermined distance for each side of the head portion when each side of the plurality of sides is rotated in contact with the armature.

16. The pusher assembly of claim 15, wherein the plurality of sides are arranged as an octagon.

17. The pusher assembly of claim 15, wherein the plurality of sides are configured as one of triangular, rectangular, pentagonal and hexagonal.

18. The pusher assembly of claim 12, wherein the predetermined interval is 0.05 millimeters.

19. The pusher assembly of claim 12, wherein the rotary adjustment includes a recessed slot for receiving a screwdriver tip to facilitate rotation of the rotary adjustment.

* * * * *